US009061857B2

(12) United States Patent
Johnson

(10) Patent No.: US 9,061,857 B2
(45) Date of Patent: Jun. 23, 2015

(54) TAPE HEAD FOR CASE SEALING

(71) Applicant: R.A. Pearson Company, Spokane, WA (US)

(72) Inventor: Michael J. Johnson, Spokane, WA (US)

(73) Assignee: R.A. Pearson Company, Spokane, WA (US)

( * ) Notice: Subject to any disclaimer, the term of this patent is extended or adjusted under 35 U.S.C. 154(b) by 90 days.

(21) Appl. No.: 13/631,501

(22) Filed: Sep. 28, 2012

(65) Prior Publication Data

US 2013/0081758 A1 Apr. 4, 2013

Related U.S. Application Data

(60) Provisional application No. 61/541,957, filed on Sep. 30, 2011.

(51) Int. Cl.

| | |
|---|---|
| ***B65H 35/06*** | (2006.01) |
| ***B65H 35/00*** | (2006.01) |
| ***B65B 51/06*** | (2006.01) |

(52) U.S. Cl.

CPC ..... *B65H 35/0013* (2013.01); *Y10T 156/17* (2015.01); *B65H 2801/81* (2013.01); *B65H 35/002* (2013.01); *B65H 35/06* (2013.01); *B65H 35/0086* (2013.01); *Y10T 156/1798* (2015.01); *Y10T 156/1082* (2015.01); *B65H 2601/31* (2013.01); *Y10T 156/1052* (2015.01); *B65H2402/541* (2013.01); *Y10T 156/18* (2015.01); *Y10T 156/1348* (2015.01); *B65H 2601/51* (2013.01); *B65B 51/067* (2013.01)

(58) Field of Classification Search

CPC ..... B65H 35/0013; B65H 35/0086; B65H 35/06; B65H 35/002; B65H 2601/31; B65H 2601/51; B65H 2402/541; B65H 2402/542; B65H 2402/543; B65H 2402/544; B65H 2402/66; B65H 2801/81; Y10T 156/1052; Y10T 156/1082; Y10T 156/1348; Y10T 156/1798; Y10T 156/18

USPC ..... 156/256, 270, 468, 475, 486, 523, 574

See application file for complete search history.

(56) References Cited

U.S. PATENT DOCUMENTS 3,915,786 A 10/1975 Collett et al.
4,640,731 A * 2/1987 Lerner et al. ..... 156/355

(Continued)

FOREIGN PATENT DOCUMENTS

EP 1454831 9/2004

OTHER PUBLICATIONS

The PCT Search Report mailed Feb. 25, 2013 for PCT application No. PCT/US12/58046, 9 pages.

*Primary Examiner* — Linda L Gray
(74) *Attorney, Agent, or Firm* — Lee & Hayes, PLLC

(57) ABSTRACT

A tape head includes a two-stage system by which a spring is tensioned. In a first stage, the spring may be partially tensioned when a case, moving along a conveyor, contacts a first application roller. The spring may be additionally tensioned when the case, continuing to move along the conveyor, contacts the second stage. In one example of the second stage, a lever is moved by contact with the moving case. Movement of the lever moves tensions the spring further. By tensioning the spring in multiple stages, assemblies and/or processes, less force is applied by the case to the first application roller. Accordingly, it is less likely to deform the case. The tensioned spring provides energy to move a second application roller around a trailing edge of the case, and thereby press a cut end of the tape against a side of the case.

6 Claims, 10 Drawing Sheets

(56) References Cited

U.S. PATENT DOCUMENTS 4,789,418 A * 12/1988 Rayl ..... 156/468
7,946,328 B2 * 5/2011 Fox et al. ..... 156/486
2009/0084504 A1 4/2009 Lam
2010/0175836 A1 7/2010 Lam

* cited by examiner

TAPE HEAD FOR CASE SEALING

RELATED APPLICATIONS

This application claims priority to U.S. Provisional Application 61/541,957, filed 30 Sep. 2011, which is incorporated herein by reference.

BACKGROUND

Tape heads may be used to tape closed the flaps of cases (e.g., cardboard boxes) moving down a conveyor system. In one example, the bottom of a case may be sealed with tape, the case may be filled with product (e.g., cans of soup, packaged consumer goods or anything else), and the top of the case may be sealed. In such an example, the sealing involves placement of a piece of tape along an area wherein the two flaps meet, so that approximately half the width of the tape is attached to each flap. Significantly, the piece of tape may be longer than a length of the flaps, so that each end of the tape bends 90 degrees and terminates in a position on a side of the case.

A tape head typically holds a spool of tape, which may include an unrolled end that may be guided by one or more guide rollers. The end of the tape may be positioned so that a first application roller causes the end to touch or contact a leading side of a case moving down the conveyor. As the case advances, the first application roller presses the tape into contact with the leading side of the case. As the case advances further, the first application roller may wrap around an edge of the case, thereby bringing the tape into contact with the adjacent flaps. In the example wherein the top of the case is being sealed, the advancing case pushes the first application roller upwardly and around the edge of the case. As the case advances further, tape is pressed into contact with both flaps by the first application roller.

As the case continues to advance, the case moves past the first application roller, and contact between the first application roller and the case terminates. At this point, the first application roller has pressed the tape against the full length of the joined flaps. The tape is cut at a length sufficient to fully tape together the flaps and also to wrap around the edge of the case. After the first application roller loses contact with the case, a second application roller continues to press the tape against the joined flaps. As the edge of the case begins to pass the second application roller, the second application roller moves around the edge of the case and presses the cut end of the tape against the trailing side of the case. The energy to move the second application roller around the edge of the case and against the trailing side of the case is obtained from allowing a spring—which was tensioned upon contact of the moving case with the first application roller—to relax.

SUMMARY

A tape head for a packaging system is described herein. In one example, the tape head includes a two-stage system by which a spring is tensioned. In a first stage, the spring may be partially tensioned when a case, moving relative to the tape head (e.g., the case may be moving along a conveyor), contacts a first application roller (e.g., a "dubbing roller"). In one example of the first stage, as the first application roller pivots in response to contact a leading sidewall of the case, a spring is tensioned (e.g., a first end of the spring is pulled while a second end of the spring is held stationary). The spring may be additionally tensioned when the case, which continues to move along the conveyor, contacts a second stage. In the second stage, the spring may be additionally tensioned when the case contacts a lever or other structure. In one example of the second stage, the first end of the spring is held stationary while the second end of the spring is pulled by operation of the lever in response to contact with the case. In other examples, two or more stages contribute to tensioning one or more springs, such as by pulling on any combination of one or both ends of any of the spring(s). Thus, while two stages and one spring are referred to in some areas of this disclosure, two or more stages and one or more springs could be used. Accordingly, the ideas expressed herein are extensible to include additional stages and/or energy storage devices, as indicated by design requirements.

By tensioning a spring in two stages, two assemblies and/or two processes, it is not necessary to apply as much force or resistance to the first application roller as would be required if only a single stage was available. Also by tensioning the spring in two stages, it is possible to store energy without deforming the case as it moves on the conveyor. The stored energy may be utilized to move the second application roller around a trailing edge of the case, and to thereby press a cut end of the tape against a trailing side of the case.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The term "techniques," for instance, may refer to device(s), system(s), method(s) and/or computer-readable instructions as permitted by the context above and throughout the document.

BRIEF DESCRIPTION OF THE DRAWINGS

The detailed description is described with reference to the accompanying figures. In the figures, the left-most digit(s) of a reference number identifies the figure in which the reference number first appears. The same numbers are used throughout the drawings to reference like features and components. Moreover, the figures are intended to illustrate general concepts, and not to indicate required and/or necessary elements.

DETAILED DESCRIPTION

Figure 1:
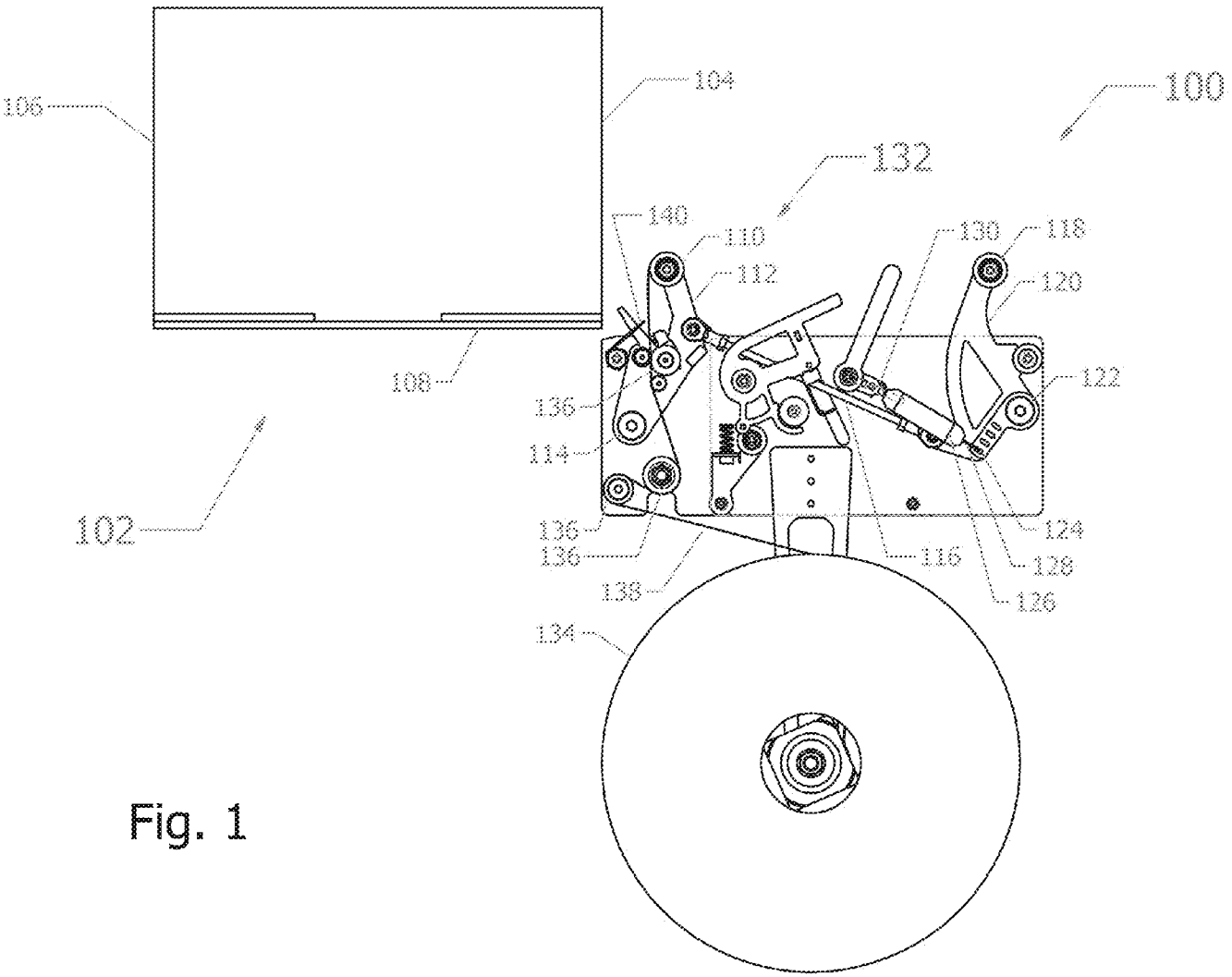
FIG. 1 is a side orthographic cross-sectional view of an example tape head for case sealing, shown prior to contact with a case, moving left to right on a conveyor (not shown).

The disclosure describes a tape head for sealing cases. In one example, the tape head is configured to join two flaps of a case into a closed position and to thereby seal the case. In the example, the tape head provides two or more stages, wherein each stage may be configured to capture energy (e.g., by stretching a spring) from contact with a case moving on a conveyor. The energy may be used (e.g., by relaxing the spring) for uses such as moving one or more rollers to press tape against surfaces of the case to be sealed.

An example tape head may be configured so that contact between the case and a first application roller results in a pivoting of the first roller and tensioning of a spring. The pivoting may result as the first application roller applies pressure to tape on the leading side of the case, and then pivots or turns around an edge of the case to apply pressure to tape joining the adjacent flaps. This tensioning of the spring by the first application roller may be considered to be a first stage of an energy capture assembly.

As the case moves forward, typically propelled along a conveyor, the case may further charge the energy storage device in response to a second contact with the case. The second contact may be made by a lever or other device, which may be rotated to provide further tensioning of the spring. This further tensioning may be considered to be a second stage of an energy capture assembly.

As the case moves past the first application roller, a second application roller continues to press tape against the two adjacent flap edges. As the case begins to pass the second application roller, the spring relaxes, forcing the second application roller to rotate, pivot or turn around the edge of the case and press an end of the tape against a trailing side of the case.

Thus, the two-stage energy-capture system tensions the spring when movement of the case pivots or otherwise moves an element in the first stage (e.g., the first application roller, a lever, etc.). The two-stage energy-capture system provides additional tension to the spring (or a second spring) when movement of the case moves an element of the second stage of the energy-capture system (e.g., a lever arm, roller, etc.). Because the second stage of the energy capture assembly is available to store added energy (e.g., to provide additional tension to the spring), no single roller, lever or other structure is required to fully tension the spring. By tensioning the spring in steps, less pressure is applied to the case at any particular time, and less deformation (e.g., denting or crunching) to the case may result.

The discussion herein includes several sections. Each section is intended to be non-limiting. More particularly, this entire description is intended to illustrate components which may be utilized in a tape head sealing apparatus, but not components which are necessarily required. The discussion begins with a section entitled "Example Tape Head Design," which describes example implementation(s) of the techniques described herein. This section depicts and describes a tape head using an example, but is intended to indicate generalized concepts that may be implemented in a variety of manners, while still in keeping with the concepts taught herein. Next, a section entitled "Example Processes" describes the operation of the tape head. This section describes operation by referencing previously discusses structures, but is intended to indicate generalized concepts that may be implemented in a variety of manners, while still in keeping with the concepts taught herein. Finally, the discussion ends with a brief conclusion.

This brief introduction, including section titles and corresponding summaries, is provided for the reader's convenience and is not intended to describe and/or limit the scope of the claims or any section of this disclosure.

Example Tape Head Design

FIGS. 1, 3, 5, 7, 9 and 11 represent a series of "snapshots," which individually and collectively show both structure and operation of an example tape head for case sealing. FIGS. 2, 4, 6, 8, 10 and 12 show the tape head of the previous figure in an alternative perspective view.

FIG. 1 shows a side orthographic cross-sectional view of an example tape head 100 for case sealing. A case 102 is shown moving from left to right on a conveyor (not shown). The case 102 is ready to be sealed, i.e., ready for the flaps to be taped together. The case includes a leading sidewall 104, which "leads," or is ahead of during travel, and a trailing sidewall 106. The case 102 includes flaps 108 that meet along a centerline, and which are to be sealed by application of tape. Thus, the flaps 108 are closed and ready to be taped together, thereby sealing the case.

Figure 3:
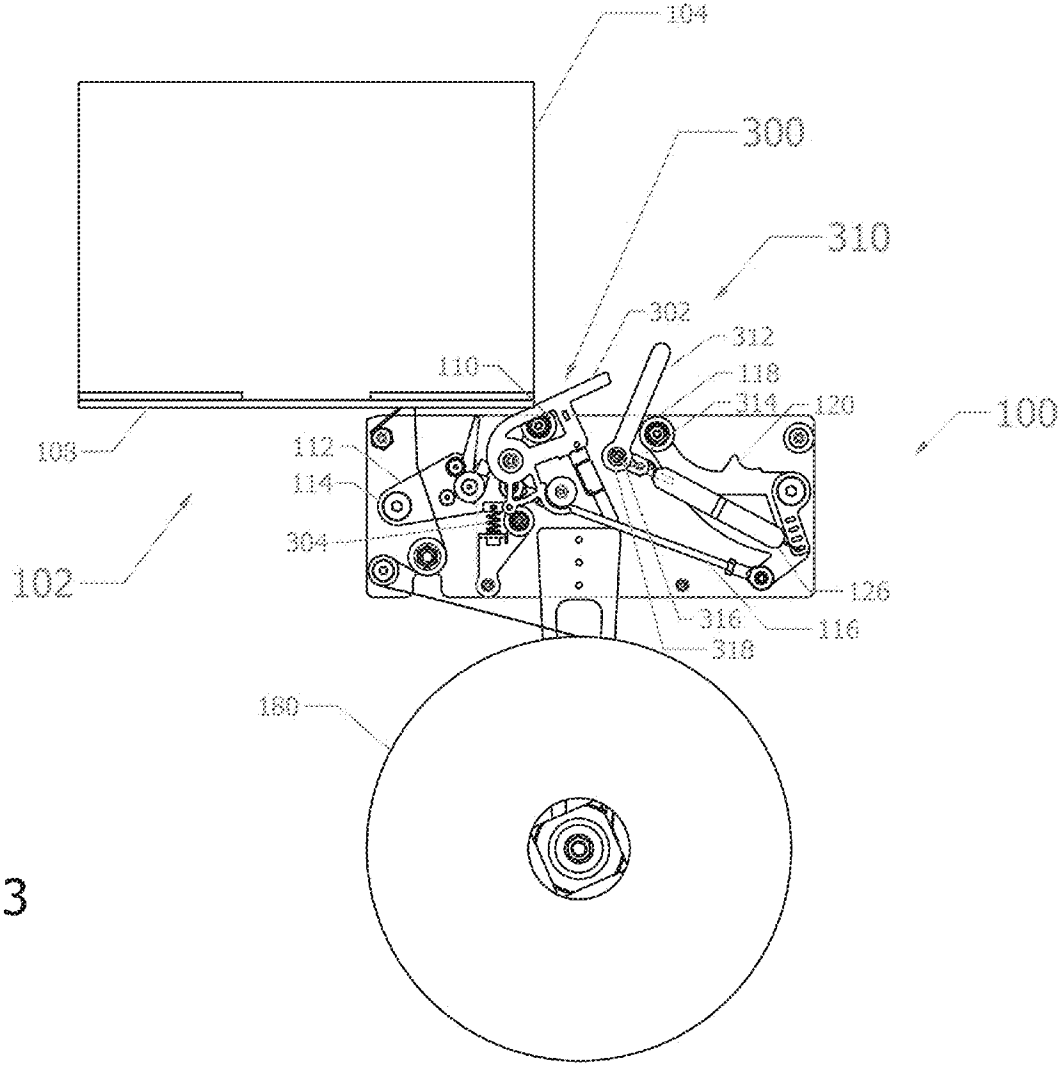
FIG. 3 is a side orthographic cross-sectional view of an example tape head for case sealing, shown after a first application roller of a first stage has moved down a leading side of the case, thereby pressing tape against the leading side of the case, and is moving about an edge of the case.

In the example of FIG. 1, the tape head 100 includes a first application roller 110. The first application roller 110 is configured to force or press adhesive tape against the case, thereby "applying" the tape to the case. The first application roller 110 may be supported by a first arm 112 and may rotate about a first pivot 114. In the view of FIG. 1, the first application roller 110 has rotated counterclockwise about the pivot 114 to a position at which it can contact the leading sidewall 104 of the case 102. (In contrast, the view of FIG. 3 shows the first arm 112 supporting the first application roller 110 rotated in a clockwise direction about the pivot 114 to a position at which it can contact the flaps 108 of the case 102.) In some tape head designs, the first arm supporting the first application roller may not pivot, but may instead slide in a track or slot. Such movement may be used to tension a spring in a manner analogous to the structures and methods described herein.

A linkage 116 may be attached to the first arm 112 supporting the first application roller 110. As can be seen, as the first arm 112 rotates about the first pivot 114, the linkage 116 drives a second arm 120 about a second pivot 122. As the second arm 120 rotates about the second pivot 122, a spring 126 is tensioned.

The second application roller 118 may be supported by a second arm 120 and may rotate about second pivot 122. In operation, the second application roller 118 may contact the case 102 after the first application roller 110 has already done so. The second application roller 118 may follow the first application roller 110, in a manner that results in both rollers sequentially applying pressure to tape joining two flaps to be sealed. In the view of FIG. 1, the second arm 120 supporting the second application roller 118 is in a position in which it was previously in contact with a trailing sidewall of a case that moved to the right and out of the figure.

The second arm 120 supporting the second application roller 118 may define one or more attachment or fastening points 124 for a spring or other energy storage device. By selecting an appropriate one of the attachment points 124, the spring may be properly tensioned and/or a desired bias may be applied to the second application roller 118.

An energy storing device may be an extension spring, compression spring, gas cylinder or other device configured to store and release energy. In the example of FIG. 1, an extension spring 126 is utilized. In the example shown, a first end 128 of the extension spring 126 is connected to fastening points 124 defined on the second arm 120. A second end 130 of the spring 126 is attached to a second stage of the energy capture assembly (described with respect to FIGS. 3 and 5).

The extension spring 126 is tensioned (i.e., stretched or extended to store energy in the spring) in a two-stage manner. In one example of the first stage, a first end 128 of the spring 126 is extended while a second end 130 of the spring is held fixed. In the second stage, a second end 130 of the spring 126 is extended while the first end 128 of the spring is held fixed.

A first stage 132 energy capture assembly tensions (e.g., elongates) the extension spring 126 when rotation of the first application roller 110 about pivot 114 pulls on the first end 128 of the spring. The first stage 132 may be considered to include one or more of: the first application roller 110 (which is pushed by the case moving on the conveyor); the first arm 112 (which rotates in response to the pressure on the roller 110); the pivot 114 about which the first arm rotates; the linkage 116 (which is moved in response to rotation of the first arm 112); the second arm 120 (which rotates in response to the urging of the linkage 116); and the second pivot 122 about which the second arm 120 rotates and the fastening points 124 defined in the second arm, which connect the first end 128 of the spring 126. Thus in the example of the first stage 132 of the energy capture system, rotation of the first application roller 110 about pivot 114 elongates the extension spring 126 by pulling on the first end 128.

From the perspective of FIG. 1, operation of the first stage 132 energy capturing system may be understood. In particular, contact by the leading sidewall 104 of the case 102 with the first application roller 110 rotates the first arm 112 clockwise about first pivot 114. In response to the clockwise rotation, the linkage 116 is moved to the right. Movement of the linkage 116 to the right causes counterclockwise rotation of the second arm 120 about second pivot 122. In response to the rotation, the fastening points 124 move the first end 128 of the spring 126 away from the fixed second end 130 of the spring. Accordingly, the first stage tensions the spring, thereby capturing energy for later use. A second stage of the tensioning is better seen by comparison of FIGS. 3 and 5, and will be discuss below.

A tape spool 134 provides tape to the tape head 100. One or more guide rollers 136A-C may be used to guide the tape 138 as it is applied to the case 102 and flaps 108 of the case during the sealing process. In operation, a non-sticky side of the tape wraps about one or more guide rollers, thereby positioning the tape as required. A tape guide 140 is a tab or small arm that supports cut end of the tape prior to contact with the leading sidewall 104 of the case 102.

Figure 2:
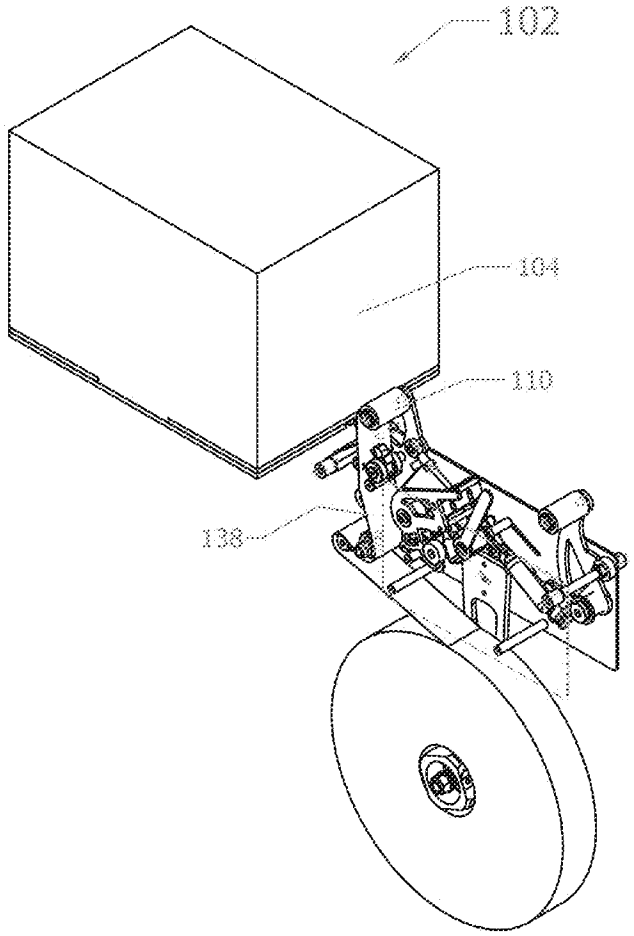
FIG. 2 is perspective view of the example tape head of FIG. 1.

FIG. 2 is perspective view of the example tape head of FIG. 1. In particular, FIG. 2 shows the tape 138 ready for application to the leading sidewall 104 of the case 102. The first application roller 110 is in position to press the tape against the leading sidewall 104, to thereby ensure adherence of the tape to the case.

FIG. 3 is a side orthographic view of the example tape head 100 for case sealing. In the view of FIG. 3, the sidewall 104 of the case 102 has contacted the first application roller 110. Force imparted by the leading sidewall 104 has caused the first arm 112 to rotate clockwise about the pivot 114. As the first arm 112 rotated, the first application roller 110 presses tape against a portion of the leading sidewall 104 of the case 102. In the view of FIG. 3, the first arm 112 has rotated sufficiently to position the first application roller 110 at a level of the flaps 108 of the case 102.

FIG. 3 shows that the linkage 116 has rotated the second arm 120 and the second application roller 118 counterclockwise sufficiently (from their position in FIG. 1) to position the roller at a level of the flaps 108 of the case 102. Due to the rotation of the second arm 120 about the second pivot 122, the extension spring 126 has been stretched. Thus, a comparison of FIGS. 1 and 3 indicate that contact between the first application roller 110 and the leading sidewall 104 of the case 102 has rotated the arms 112, 120 to position rollers 110, 118 at a level of the flaps to be sealed. Also this point, a first stage of the extension of the spring 126 has been completed.

A tape cutting assembly 300 is configured to cut the tape at a length that allows the tape to fully seal the case by connecting the adjacent flaps and wrapping over the edge of the case. In one example, the tape cutting assembly includes a lever 302 which tensions a spring 304 for a later cut, a guard which retracts prior to cutting and a blade which slices the tape. In the view of FIG. 3, the lever 302 is being pressed, thereby tensioning the spring for a later cut, when the lever is released as the case moves forward.

FIG. 3 also shows a second stage 310 of the energy capture assembly. A primary lever 312 is positioned in the path of the case 102 as the case moves down the conveyor. Pivoting movement of the primary lever 312 moves a secondary lever 314. A difference in the lengths of the primary and secondary levers provides a mechanical advantage when tensioning the spring. In the example of FIG. 3, the primary lever 312 is longer than the secondary lever 314. However, in some applications the primary lever could be shorter or equal to the length of the secondary lever. A longer primary lever arm 312 provides mechanical advantage by allowing a case to apply less force over a longer distance to the longer lever arm, and for the shorter lever arm to apply a greater force over a shorter distance when tensioning the spring. In the example of FIG. 3, the primary lever 312 and the secondary lever 314 are both attached to a collar 316 which rotates on an axle 318. The second end 130 of the extension spring 126 may be attached to the secondary lever 314.

In one example of operation, after the case 102 has contacted the first application roller and tensioned the spring 126, the case is moved by the conveyor to push on, and rotate, the primary lever 312. Movement of the primary lever 312 results in rotation of the collar 316 about axle 318. The rotation causes movement of the secondary lever 314, which can pull on the second end 130 of the spring 126, thereby tensioning it further. Accordingly, the spring is further elongated and tensioned by the second stage 310 of the energy capture system. By tensioning the spring in two or more steps, the case applies less force at any given time to a lever or roller, thereby making deformation of the case less likely.

In a second implementation of the second stage 310, movement of the primary lever 312 moves a secondary lever 314 in a manner that may not significantly increase tension on the spring 126, and may even result in a modest decrease in tension. However, movement of the secondary lever 314 may position the second end 130 of the spring in a position or location that results in the spring 126 more efficiently and/or effectively operating the second application roller 118 to press tape against the trailing sidewall 106 of the case 102.

Figure 4:
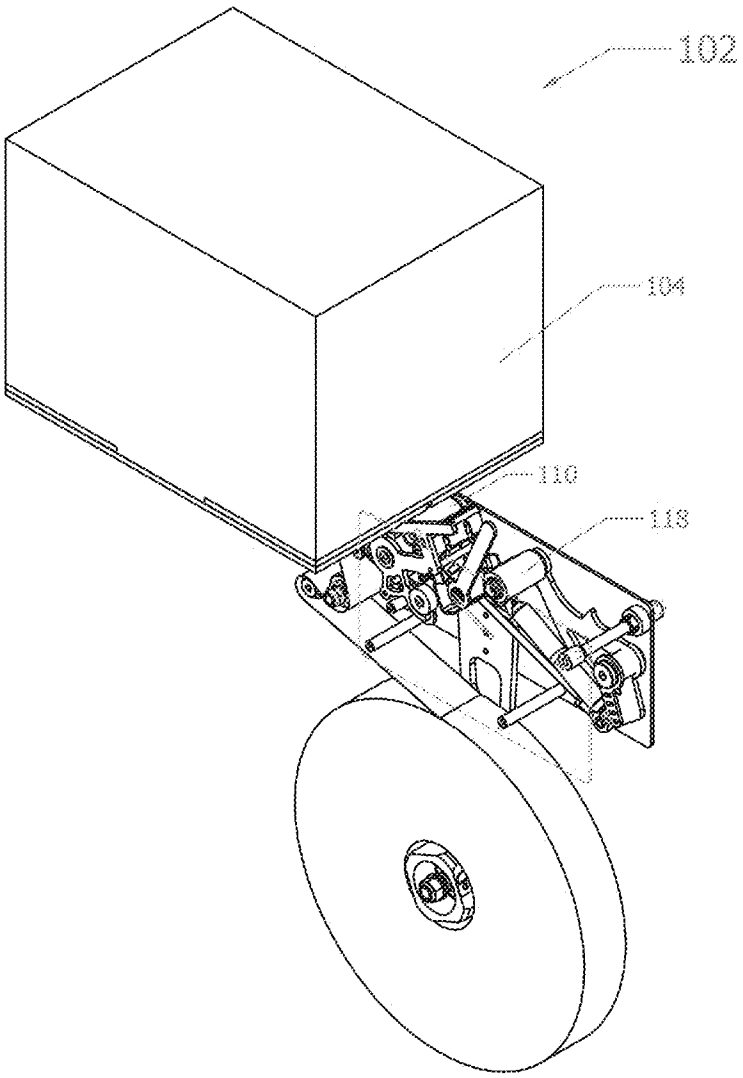
FIG. 4 is perspective view of the example tape head of FIG. 3.

FIG. 4 is perspective view of the example tape head of FIG. 3. In particular, a segment of tape has been applied to the leading sidewall 104 of the case 102, and the first application roller 110 is beginning to apply tape along the length of the adjacent flaps of the case. The second application roller 118 has not yet contacted the tape.

Figure 5:
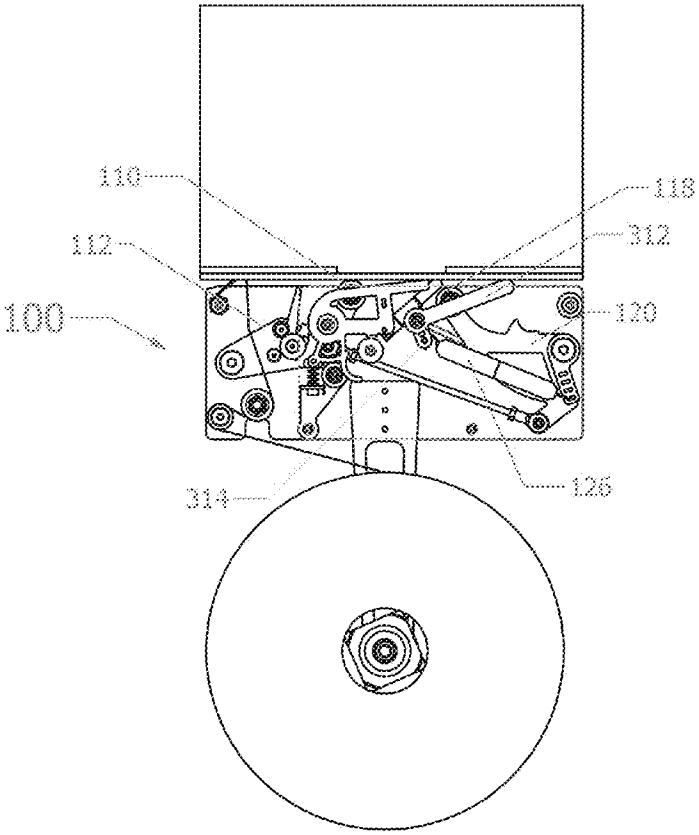
FIG. 5 is a side orthographic cross-sectional view of an example tape head for case sealing, shown as a lever within the second stage of an energy capture assembly has been pushed by the moving case and as the first and second application rollers press tape against the joined edges of two adjacent flaps of the case.

FIG. 5 is a side orthographic view of an example tape head 100 for case sealing. In the view of FIG. 5, the first application roller 110 and the second application roller 118 are both in contact with a length of tape that is partially applied to the two adjacent flaps of the case. The first arm 112 of the first application roller 110 has rotated fully clockwise, and the second arm 120 of the second application roller 118 has rotated fully counterclockwise. Accordingly, the spring 126 has been fully elongated by the first stage of the energy capture assembly. The primary lever 312 of the second stage of the energy system is fully rotated clockwise, resulting in the secondary lever 314 fully extending the spring 126. Accordingly, the spring 126 has been fully elongated by the second stage of the energy capture assembly.

Figure 6:
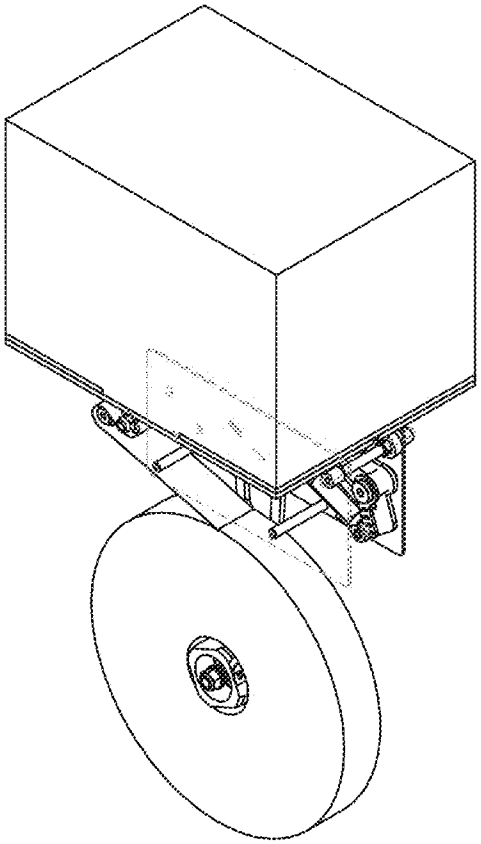
FIG. 6 is perspective view of the example tape head of FIG. 5.

FIG. 6 is perspective view of the example tape head of FIG. 5, showing that tape has been applied to approximately half of the distance between the two adjacent flaps.

Figure 7:
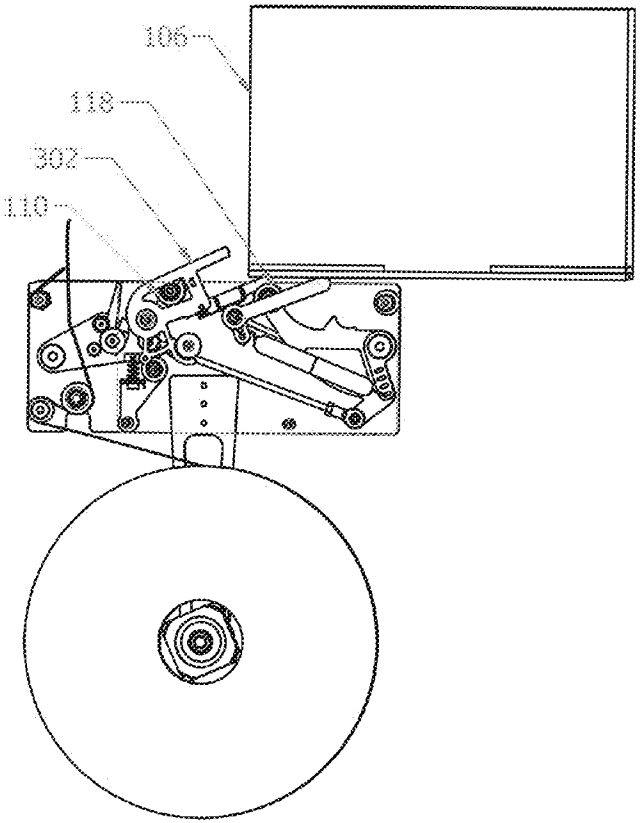
FIG. 7 is a side orthographic cross-sectional view of an example tape head for case sealing, shown at a point where the first application roller is no longer in contact with the case, and the second application roller is almost ready to make a 90-degree turn up the trailing side of the case.

FIG. 7 is a side orthographic view of an example tape head for case sealing, shown as the first application roller 110 is no longer in contact with the case, and the second application roller 118 is almost ready to make a 90-degree turn up the side of the trailing side 106 of the case 102. The lever 302 of the tape cutting assembly has been released, releasing energy in the spring and allowing the blade to cut tape.

Figure 8:
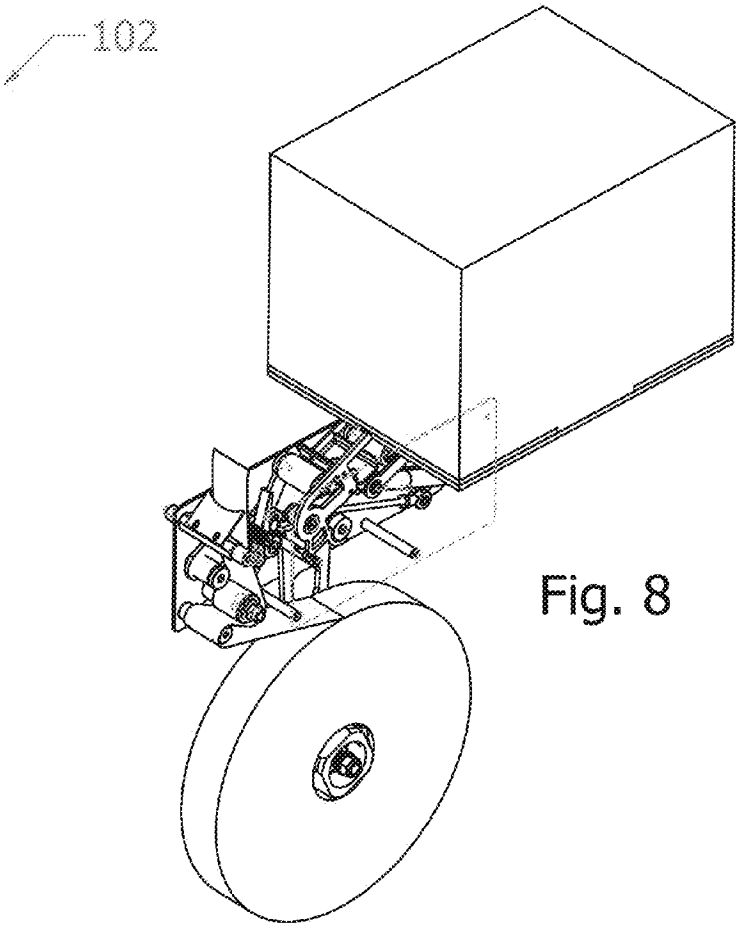
FIG. 8 is perspective view of the example tape head of FIG. 7.

FIG. 8 is perspective view of the example tape head of FIG. 7.

Figure 9:
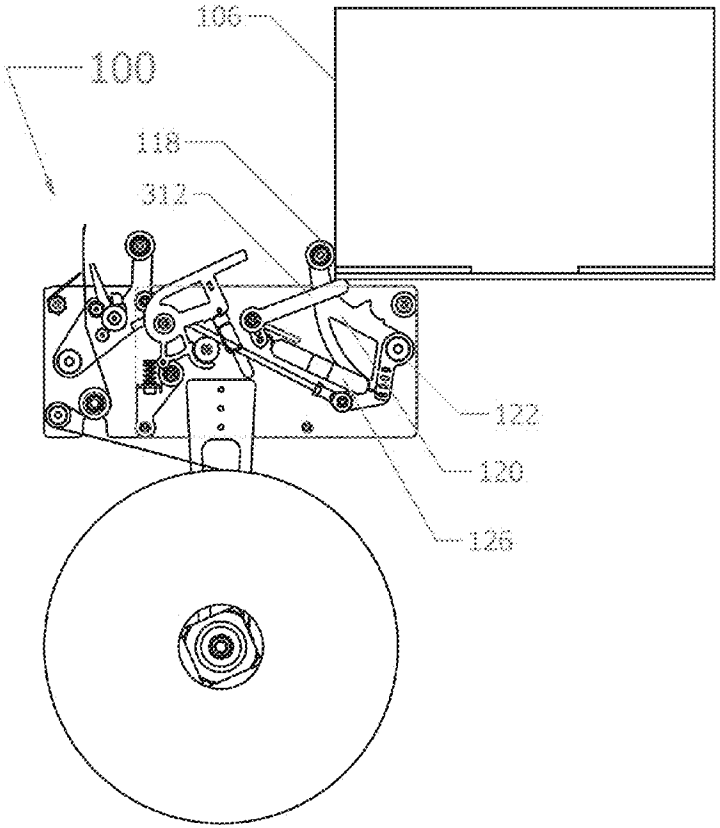
FIG. 9 is a side orthographic cross-sectional view of an example tape head for case sealing, shown as the second application roller begins to move up the trailing sidewall of the case using power from a spring charged by both the first and second stages.
Figures 11, 12:
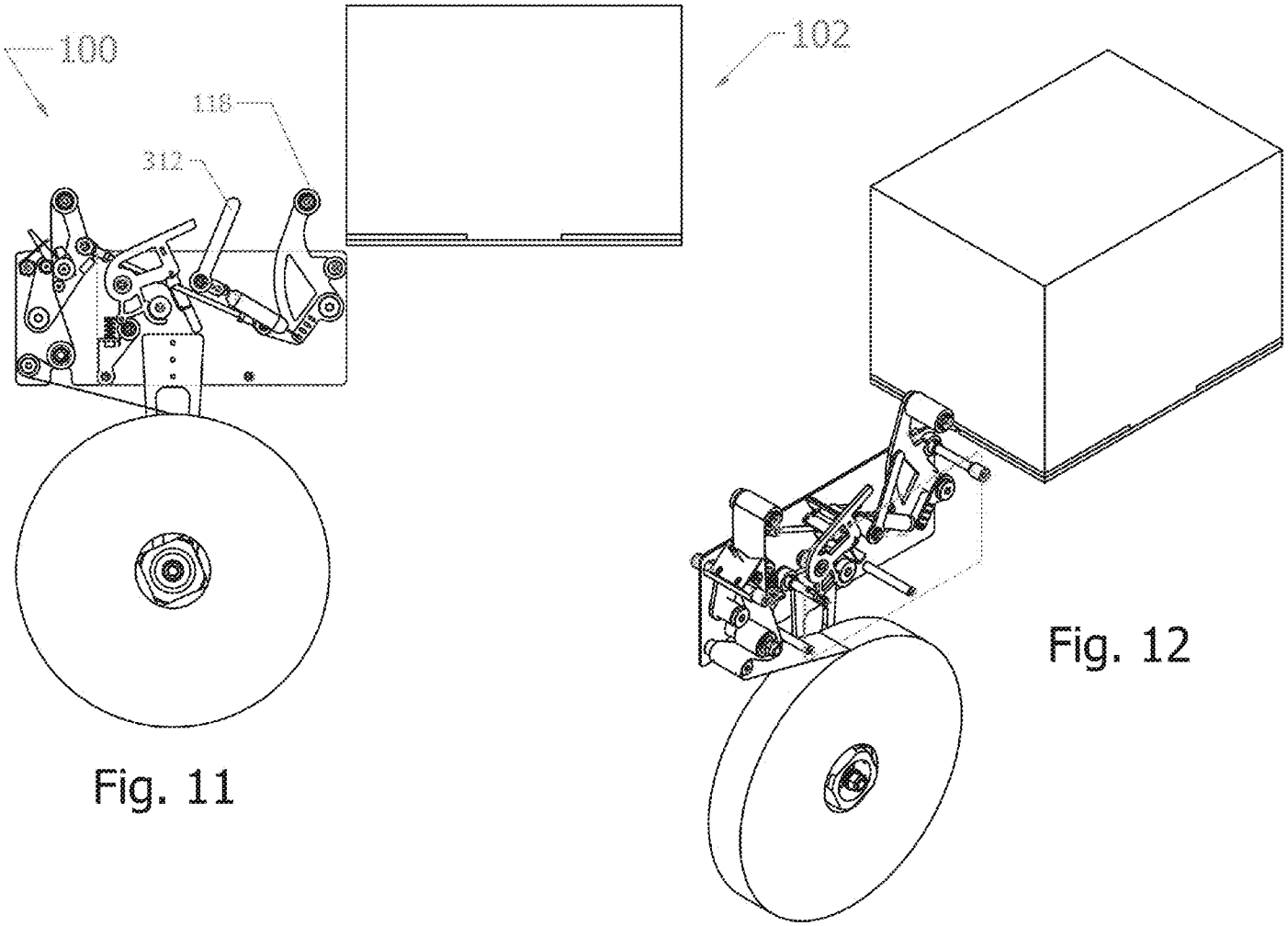
FIG. 11 is a side orthographic cross-sectional view of an example tape head for case sealing, shown as the sealing process of the case moving on the conveyor (not shown) has been completed, and as the case moves away from the second application roller of the tape head.
FIG. 12 is perspective view of the example tape head of FIG. 11.

FIG. 9 is a side orthographic view of an example tape head 100 for case sealing, shown as the second application roller 118 begins to move up the trailing sidewall 106 of the case. In particular, the second arm 120 has begun to rotate clockwise about the second pivot 122. Accordingly, the second application roller 118 is pressing or "applying" tape on a portion of the trailing sidewall 106. The tensioned spring 126 is returning to its relaxed state, as it pulls second arm 120 and second roller 118 in the clockwise direction. Thus, a comparison of FIGS. 7 and 9 reveals that the second application roller 118 has transitioned from application of tape to the adjacent flaps on the bottom of the case (as seen in FIG. 7), and wrapped around the edge of the case to apply tape to the trailing side of the case (as seen in FIG. 9). Referring to FIG. 9, the second application roller 118 has already wrapped about the 90-degree edge of the case 102 and the primary lever arm 312 is still in contact with the bottom of the case. When the case 102 advances further (as seen in FIG. 11) the primary lever arm 312 will have "popped up," after losing contact with the case and due to a relaxation of tension on the spring 126. However, because the second application roller 118 has already wrapped about the edge of the case and made contact with the trailing sidewall 106, the second application roller will be able to apply sufficient pressure to apply the tape.

Figure 10:
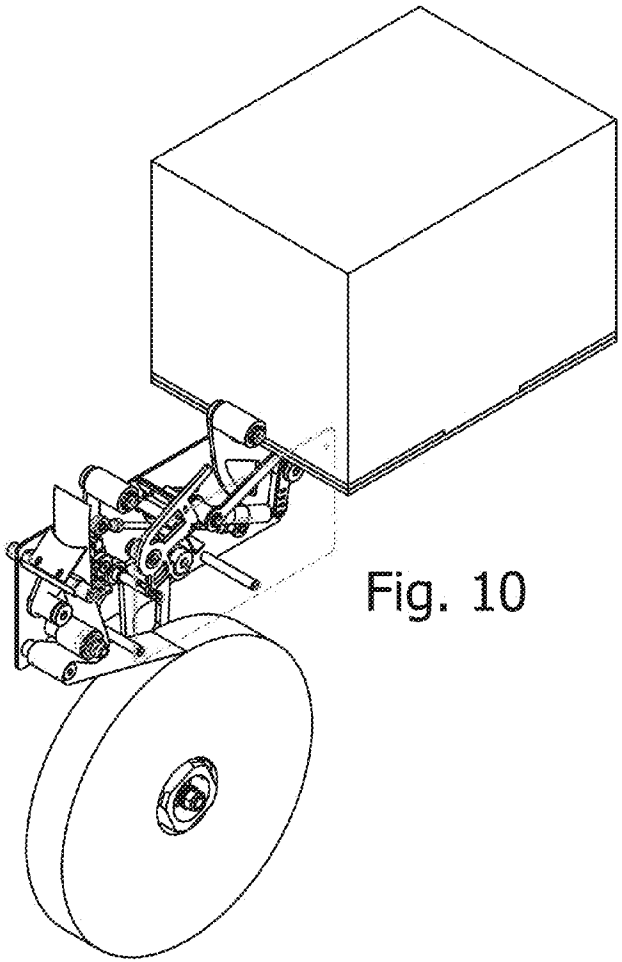
FIG. 10 is perspective view of the example tape head of FIG. 9.

FIG. 10 is perspective view of the example tape head of FIG. 9.

FIG. 11 is a side orthographic view of an example tape head 100 for case sealing, shown as the case, moving to the right on the conveyor (not shown), moves away from the second application roller 118 of the tape head 100. At this point, the case 102 has been fully sealed. The primary lever arm 312 has pivoted into a position that will allow a subsequent case to make contact with, and push, the lever.

FIG. 12 is perspective view of the example tape head of FIG. 11.

Example Processes

Figure 13:
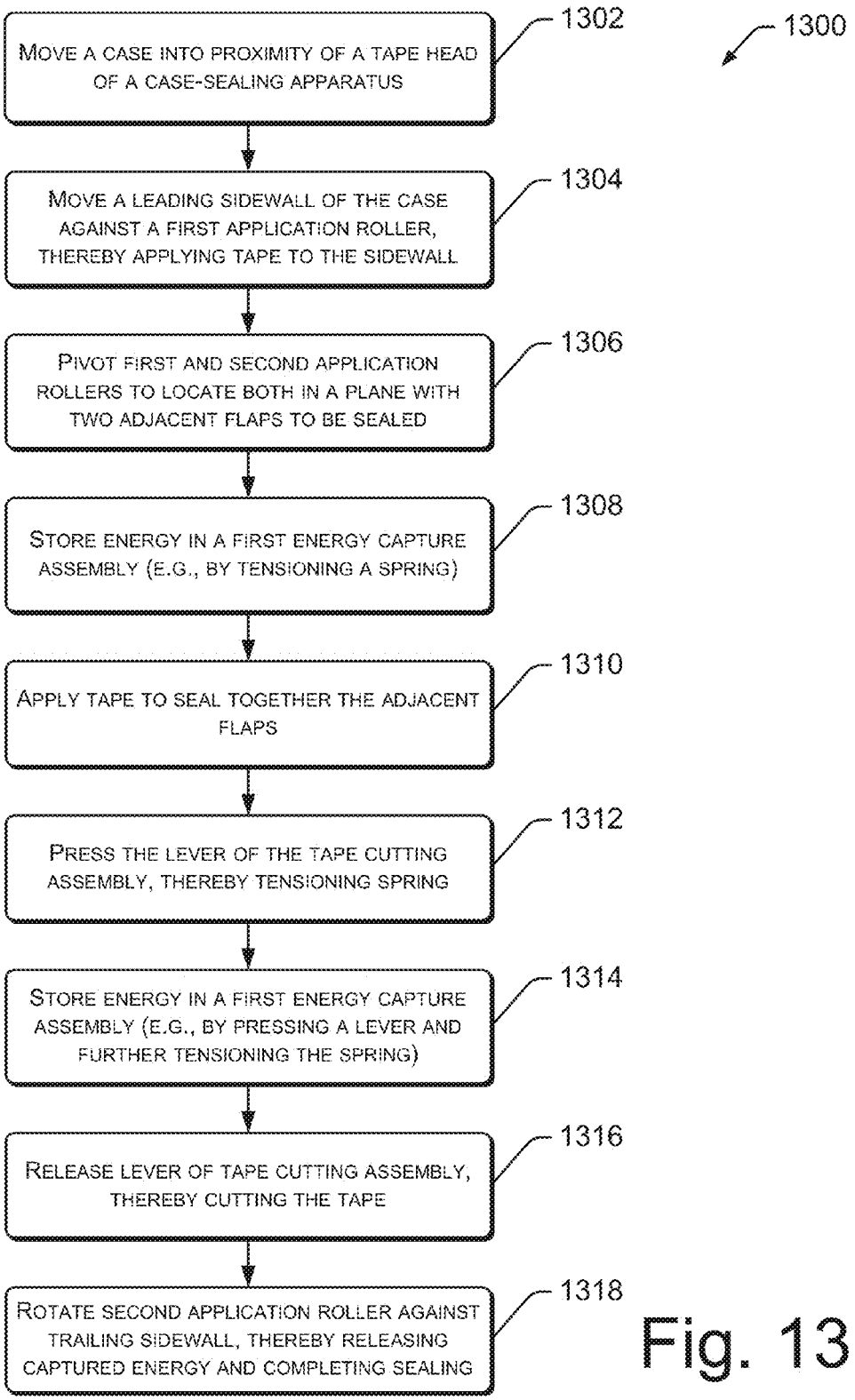
FIGS. 13 and 14 are flow diagrams illustrating example processes by which a tape head seals a case.
Figure 14:
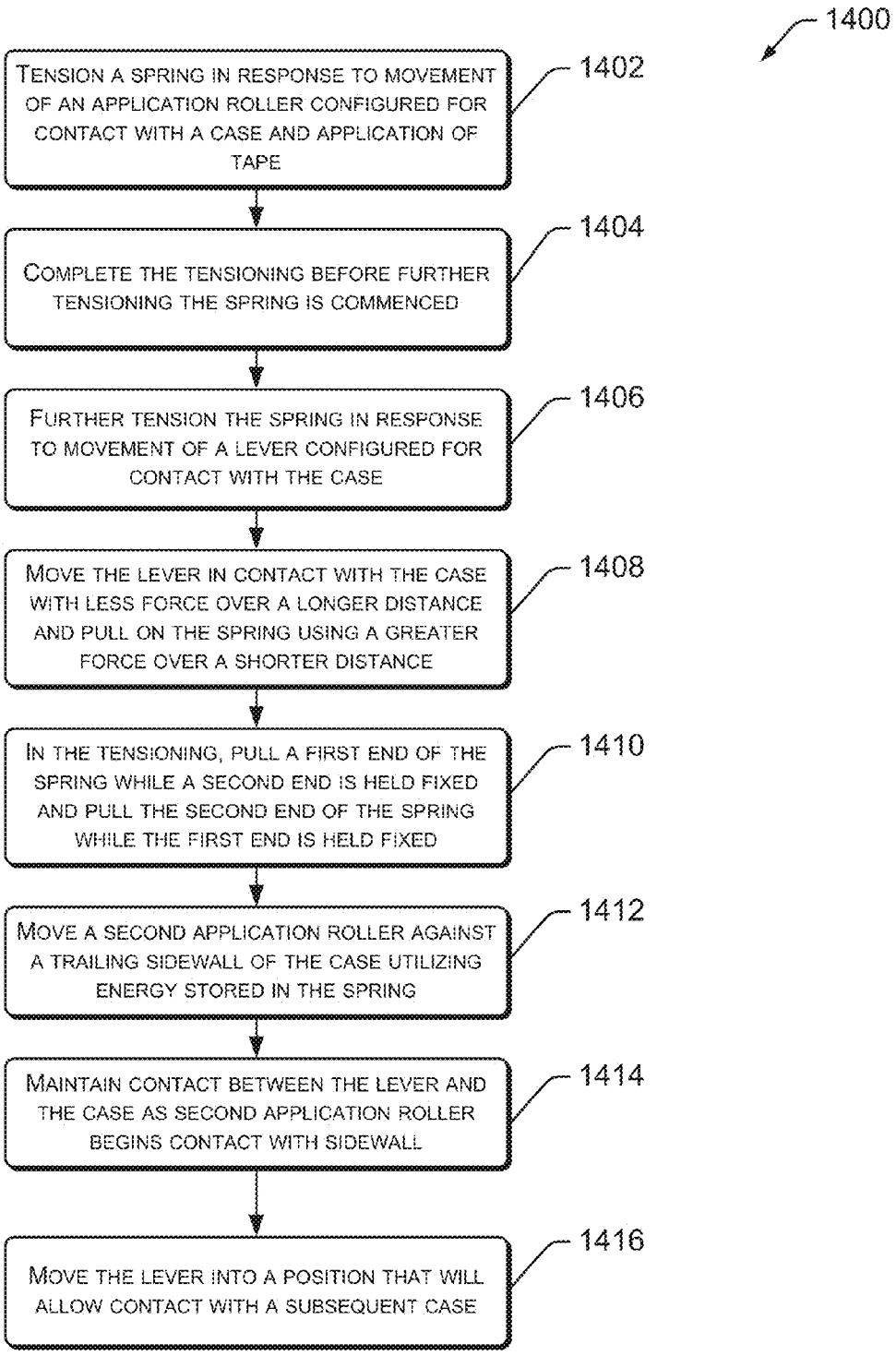

The example processes of FIGS. 13-14 can be understood in part by reference to the configurations of FIGS. 1-12. However, FIGS. 13-14 contain general applicability, and are not limited by other drawing figures and/or prior discussion.

FIG. 13 is a flow diagram illustrating an example process 1300 by which a tape head seals a case, such as by taping together adjacent flaps on a top and/or bottom of the case. In particular, a multi-stage process is involved, wherein an energy capture assembly captures energy from the motion of a case moving on a conveyor belt, and uses the energy to assist in the operation of rollers that apply tape to a case. In one example, the energy capture assembly includes a two-stage process, wherein a first stage includes pulling a first end of a spring in response to contact with a leading sidewall of the case and a first application roller. In a second stage, the case contacts a lever, resulting in extension of the other end of the spring. Thus, the spring is extended, first by pulling one end, and then by pulling the other end. Upon completion of the taping of the flaps, a second application roller wraps about the edge of the case, applying the end of the tape to the trailing sidewall. This movement of the second application roller may be driven by relaxation of the spring.

At operation 1302, a case moves into proximity of a tape head of a case-sealing apparatus. In a typical example, the case is moving on a conveyor. In the context of the example of FIG. 1, a first end of the tape is positioned next to a first application roller 110, which will press or apply the tape against the leading sidewall when the case moves into contact with the first application roller.

At operation 1304, a leading sidewall of the case is moved into contact with a first application roller, thereby applying the tape to the leading sidewall of the case. In the context of the example of FIGS. 1 and 3, tape is applied to a leading sideway in the action taking place between the snapshots of FIG. 1 and FIG. 3.

At operation 1306, first and second application rollers pivot to locate both in a plane to allow contact with two adjacent flaps to be sealed. In the context of the example of FIGS. 1 and 3, the leading sidewall 104 of the case 102 has pushed the first application roller 110, thereby rotating first arm 112 clockwise about first pivot 114. Due to the linkage 116, the second arm 120 and the second application roller 118 are rotated counterclockwise about second pivot 122.

At operation 1308, energy is stored by a first energy capture assembly, such as by tensioning a spring. In the context of the example of FIGS. 1 and 3, force by a leading edge 104 of a case against the first application roller 110 rotates the roller and first arm 112 about the first pivot 114. The rotation results in movement of linkage 116, which pulls on a first end 128 of the spring 126, while the second end 130 of the spring is fixed.

At operation 1310, tape is applied to seal together adjacent flaps of the case. In the context of the example of FIG. 5, the first application roller 110, followed by the second application roller 118, are shown pressing tape against the joined flaps of the case, which is moving from the left to the right.

At operation 1312, a lever of the tape cutting assembly is pressed, thereby tensioning a spring in that assembly. In the context of the example of FIGS. 3 and 5, it can be seen that lever 302 has been depressed by the moving case. This energizes a spring in the tape cutting assembly, so that when the lever is later released a knife will cut the tape.

At operation 1314, energy is stored by a second energy capture assembly, such as by further tensioning the spring. In the context of the example of FIGS. 3 and 5, it can be seen that primary lever arm 312 has been depressed by the moving case. This results in rotation of collar 316 about axle 318. The rotation results in movement of secondary lever arm 314, which pulls a second end 130 of spring 126 away from the first end 128 of the spring. Accordingly, the spring is further stretched or tensioned. This tensioning is in addition to the tensioning performed at operation 1308.

At operation 1316, the lever of the tape cutting assembly is released, causing the tape to be cut. In the context of the example of FIGS. 5 and 7, the lever 302 (see FIG. 7) of the tape cutting assembly 300 (shown generally at FIG. 3) is released, due to movement of the case to the right, allowing the lever 302 to pop up and the blade to cut the tape.

At operation 1318, the second application roller is rotated about an edge of the case, and against the trailing sidewall. An end of the tape is applied to the trailing sidewall, and the taping of the flaps is completed. In the context of the example of FIG. 7, the second application roller 118 has pressed tape against an entire length of the adjacent flaps. As the case passes roller 118, the roller is no longer held down. As seen in FIG. 9, the application roller 118 pops up, and begins to press the last inches of tape (the end of which has been cut) against the trailing sidewall 106 of the case 102. The application roller 118 is driven by spring 126 as it moves from a tensioned state to a relaxed state. In particular, spring 126 turns second arm 120 in the clockwise direction, thereby pressing the second application roller 118 against tape applied to the trailing sidewall 106 of the case 102.

FIG. 14 is a flow diagram illustrating an example process 1400 by which a tape head seals a case, such as by taping together adjacent flaps on a top and/or bottom of the case. In particular, a two-stage energy capture system stretches or energizes a spring or other energy storage device in a two-step process, thereby avoiding excessive force against a case moving on a conveyor, whose energy of movement is used to charge the system. Thus, a multi-stage system applies a lesser resistance to movement of the case over a longer period of its travel, thereby avoiding deformation of the case due to pressure against the case by rollers and/or lever arms.

At operation 1402, a spring is tensioned in response to movement of an application roller. The application roller may be configured for contact with a case, and for application of tape to seal the case. Thus, the application roller presses or applies the tape to the case to seal the flaps closed. When the application roller first contacts the case, which may be moving on a conveyor belt, an arm supporting the roller rotates or pivots about an axle, and the pivoting motion results in tensioning of a spring. In the context of the example of FIGS. 1 and 3, rotation of the roller 110 about pivot 114 moves linkage 116 and results in tensioning of spring 126.

At operation 1404, in a system where the spring is tensioned in steps or stages, the tensioning of a first step may be completed before further tensioning of the spring is commenced. In other systems, some overlap of the multi-step tensioning process may be present.

At operation 1406, a lever configured for contact with the case may cause further tensioning of the spring. In the context of the example of FIG. 3, primary lever arm 312 is seen in an elevated position. As the case moves to the right, the case contacts the primary lever arm 312 (as seen in FIG. 5). The contact rotates the primary lever arm 312 about pivot or axle 318. Corresponding movement of the secondary lever arm 314 results in tensioning of the spring 126.

At operation 1408, in the example of FIGS. 3 and 5, the primary lever arm is moved with less force over a longer distance than the secondary lever arm 314, which pulls on the spring 126 over a shorter distance, but with greater force.

At operation 1410, the tensioning of operations 1402 and 1408 may be performed according to a pattern wherein one or both ends of the spring 126 is pulled and/or held fixed, and the pulling is performed to overlap and/or not overlap in time. For example, operation 1402 may include pulling a first end of the spring while a second end is held fixed, and operation 1408 may include pulling on the second end of the spring while the first end is held fixed.

At operation 1412, a second application roller is moved to apply tape against a trailing sidewall of the case. The second application roller may be driven by the spring, as it relaxes. In the context of the example of FIG. 9, the second application roller 118 has begun to move up the trailing sidewall 106 and to apply an end of the tape as it moves.

At operation 1414, the lever 312 remains in contact with the case as the second application roller begins contact with the sidewall. The contact prevents premature relaxation of the spring. However, at operation 1416 the lever slides past the end of the case, and moves into a position that will allow contact with a subsequent case.

CONCLUSION

Although the subject matter has been described in language specific to structural features and/or methodological acts, it is to be understood that the subject matter defined in the appended claims is not necessarily limited to the specific features or acts described. Moreover, descriptions, such as "clockwise," "counterclockwise," "left" and "right" are understood to be for purposes of example and description only, and not for purposes of limitation. Thus, while rotation may appear "clockwise" from one perspective, the same rotation is "counterclockwise" from the reverse perspective. Accordingly, such terms, and others, are for descriptive purposes only, and are not. And generally, the specific features and acts are disclosed as exemplary forms of implementing the claims.

What is claimed is:

1. A method of operating a tape head, comprising:

charging an energy storage device in response to a contact with a case by an application roller, wherein charging the energy storage device comprises tensioning a spring by pulling on a first end of the spring while a second end of the spring is fixed;

further charging the energy storage device, wherein the further charging is performed after completion of the charging of the energy storage device, wherein the further charging is in response to movement of a lever responsive to contact with the case, wherein the further charging uses the movement of the lever to further charge the energy storage device, and wherein the further charging of the energy storage device comprises tensioning the spring by pulling on the second end of the spring while the first end of the spring is held fixed; and utilizing energy stored in the energy storage device to move a second application roller against the case.

2. The method of claim 1, wherein:

charging the energy storage device comprises tensioning the spring in response to rotation of the application roller; and further charging the energy storage device comprises further tensioning the spring in response to movement of the lever caused by movement of the case pushing on the lever.

3. The method of claim 1, wherein further charging of the energy storage device is performed by movement of the lever as the application roller moves along a top surface of the case.

4. The method of claim 1, wherein charging of the energy storage device tensions the spring and is completed before further charging of the energy storage device further tensions the spring.

5. The method of claim 1, wherein:

further charging the energy storage device comprises rotation of the lever in response to a second contact with the case;

the lever comprises a primary lever arm configured to contact the case and a secondary lever arm connected to a spring; and the primary lever arm is longer than the secondary lever arm.

6. The method of claim 1, wherein the second application roller begins to move against the trailing sidewall while the lever is still in contact with the case.

* * * * *